US008735807B2

(12) United States Patent
Mitchell et al.

(10) Patent No.: US 8,735,807 B2
(45) Date of Patent: May 27, 2014

(54) FORWARD AND REVERSE SCANNING FOR A BEAM INSTRUMENT

(75) Inventors: Ian Russell Mitchell, Pflugerville, TX (US); Scott T. Quarmby, Round Rock, TX (US); Daniel R. Benkman, Austin, TX (US)

(73) Assignee: Thermo Finnigan LLC, San Jose, CA (US)

( * ) Notice: Subject to any disclaimer, the term of this patent is extended or adjusted under 35 U.S.C. 154(b) by 82 days.

(21) Appl. No.: 12/826,292

(22) Filed: Jun. 29, 2010

(65) Prior Publication Data

US 2011/0315866 A1 Dec. 29, 2011

(51) Int. Cl.

| | |
|---|---|
| ***H01J 49/42*** | (2006.01) |
| ***H01J 49/26*** | (2006.01) |
| ***H01J 49/00*** | (2006.01) |

(52) U.S. Cl.

CPC ..... *H01J 49/429* (2013.01); *H01J 49/0031* (2013.01)

USPC ..... 250/282; 250/290

(58) Field of Classification Search

CPC ..... H01J 49/429; H01J 49/0031

USPC ..... 250/281–282, 290

See application file for complete search history.

(56) References Cited

U.S. PATENT DOCUMENTS

| | | | | |
|---|---|---|---|---|
| 5,696,376 | A | 12/1997 | Doroshenko et al. | |
| 7,326,924 | B2 * | 2/2008 | Ding et al. | 250/282 |
| 7,456,396 | B2 * | 11/2008 | Quarmby et al. | 250/292 |
| 7,482,580 | B2 | 1/2009 | Prest et al. | |
| 2005/0029448 | A1 * | 2/2005 | Chang et al. | 250/292 |
| 2006/0192112 | A1 * | 8/2006 | Mordehal | 250/290 |
| 2007/0075239 | A1 * | 4/2007 | Ding et al. | 250/282 |
| 2007/0090287 | A1 | 4/2007 | Foote et al. | |
| 2007/0164208 | A1 * | 7/2007 | Quarmby et al. | 250/282 |
| 2008/0048112 | A1 * | 2/2008 | Makarov et al. | 250/290 |
| 2008/0142705 | A1 * | 6/2008 | Schwartz et al. | 250/292 |
| 2008/0302958 | A1 * | 12/2008 | Green | 250/282 |
| 2010/0072362 | A1 * | 3/2010 | Giles et al. | 250/287 |
| 2010/0084552 | A1 * | 4/2010 | Kawana | 250/288 |
| 2010/0237237 | A1 * | 9/2010 | Green et al. | 250/283 |
| 2010/0320377 | A1 * | 12/2010 | Cotter et al. | 250/283 |
| 2011/0101221 | A1 * | 5/2011 | Mukaibatake et al. | 250/292 |

FOREIGN PATENT DOCUMENTS

| | | | |
|---|---|---|---|
| GB | 2381653 | A | 5/2003 |
| JP | 2008281469 | A * | 11/2008 |
| WO | 2008071923 | A2 | 6/2008 |

* cited by examiner

*Primary Examiner* — David A Vanore
*Assistant Examiner* — Wyatt Stoffa
(74) *Attorney, Agent, or Firm* — Pamela Lau Kee; Thomas F. Cooney

(57) ABSTRACT

A quadrupole mass spectrometer alternates between increasing mass and decreasing mass scans for the purpose of decreasing inter-scan delays. By alternating increasing and decreasing mass scans, the next scan starts where the last scan ended reducing the settling time required. Backsteps may be eliminated by scanning the RF and DC non-linearly.

9 Claims, 10 Drawing Sheets

FORWARD AND REVERSE SCANNING FOR A BEAM INSTRUMENT

BACKGROUND

Fast scanning is becoming very important in gas chromatography (GC) and mass spectroscopy (MS) where fast chromatography is reducing run time and improving productivity. Mass spectrometers need to keep up. The market wants instruments that can acquire more than 50 spectra/s over 200 amu.

Currently, quadrupole mass spectrometers scan in one direction. Some instruments scan from low mass to high mass. Others scan from high mass to low mass. Neither offers a significant advantage over the other. FIG. 1 shows a forward scan for a prior art mass spectrometer.

In prior art scanning techniques, the inter-scan delay time, the time between scans includes settling time and backsteps. Settling time is the time required to get the RF and DC rod driver outputs back to the starting point. Backsteps allow the linear control system of the RF and DC time to start tracking the setpoint.

SUMMARY

A beam instrument, e.g. quadrupole mass spectrometer, alternates between increasing mass and decreasing mass scans for the purpose of decreasing inter-scan delays. By alternating increasing and decreasing mass scans, the next scan starts where the last scan ended reducing the settling time required. Backsteps may be eliminated by scanning the RF and DC non-linearly.

BRIEF DESCRIPTION OF THE DRAWINGS

FIG. 4A is an embodiment of a prior art RF control system. FIG. 4B is another embodiment of a prior art RF control system.

DETAILED DESCRIPTION

Figure 2:
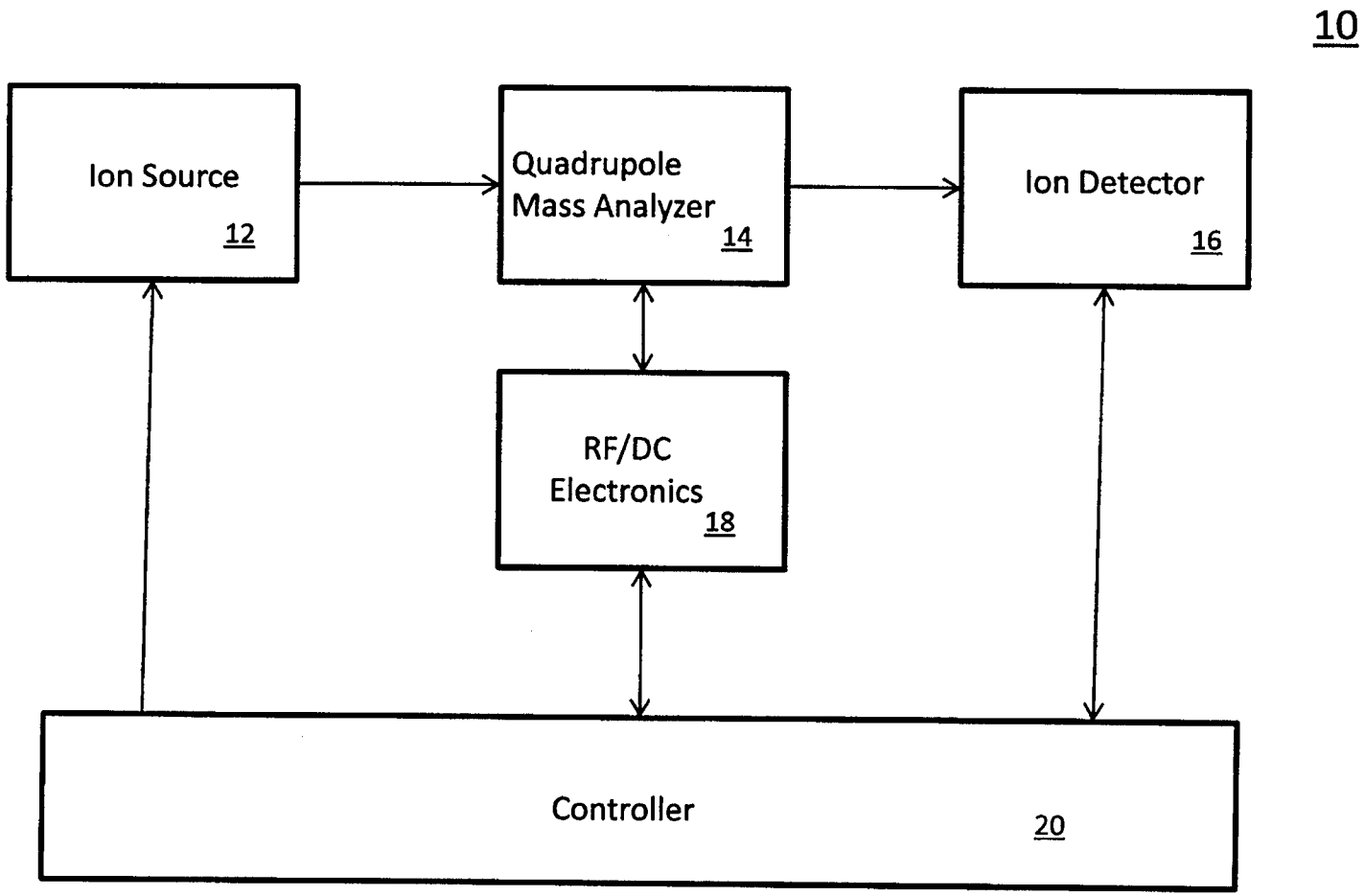
FIG. 2 shows a system diagram for a Quadrupole Mass Spectrometer.

FIG. 2 shows a system diagram for a typical quadrupole mass spectrometer 10. The source 12 is where the chemical samples are taken in and (if necessary) converted to ions. The analyzer 14 is where the ions are separated according to mass. The detector 16 is where the separated ions produce a signal that can be interpreted by scientists. RF/DC electronics 18 bidirectionally communicates with the analyzer 14. A controller 20 interacts with the ion source 12, ion detector 16, and the RF/DC electronics 18.

The ion source 12 may be of any type including but not limited to electron ionization (EI), chemical ionization (CI), electro spray ionization (ESI), and atmospheric pressure chemical ionization (APCI).

Alternatively, this invention can be applied to any beam mass spectrometer such as a quadrupole mass analyzer or magnetic sector.

Figure 3:
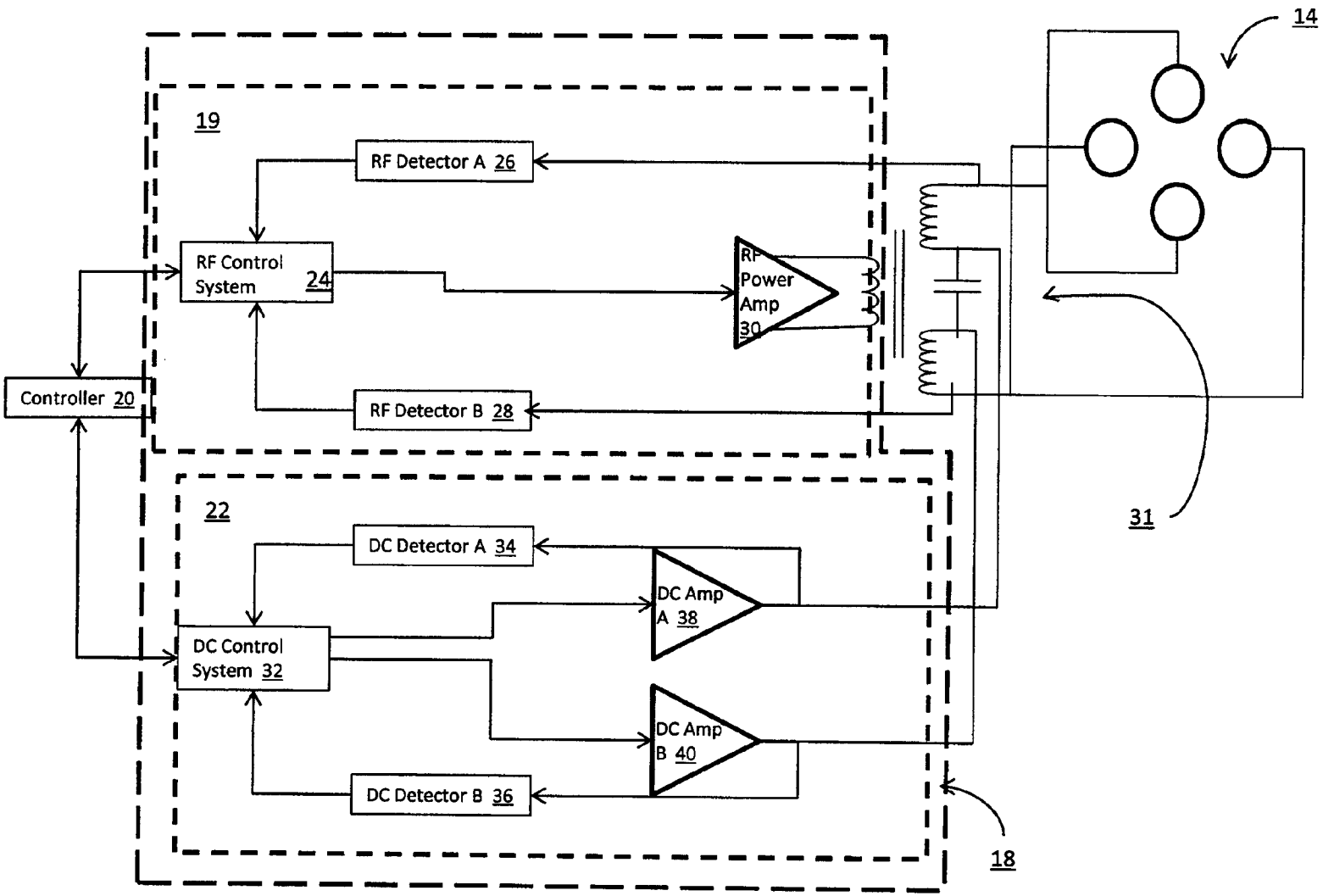
FIG. 3 is schematic diagram of the RF/DC electronics shown in FIG. 2.

FIG. 3 is schematic diagram of the RF/DC electronics 18 shown in FIG. 2.

In operation, two signals are applied to the two pairs of quadrupole rods of the mass analyzer 14. Each signal has an RF and DC component.

For the RF electronics 19, the RF control system 24 receives inputs from the controller 20, a RF detector A 26, and a RF detector B 28. A RF power amplifier 30 receives the output of the RF control system 24. RF is applied by the RF power amplifier 30 driving the primary of a high-Q coil. The secondary of the high-Q coil is split to apply different DC amplitudes on each half. The RF amplitude on each half is opposite in phase. The RF amplitude on each pair of rods may be the same amplitude or alternatively, one pair of rods gets a slightly higher amplitude.

For the DC electronics 22, the DC control system 32 receives the inputs from the controller 20, a DC Detector A 34, and DC Detector B 36. A DC Amplifier A 38 receives the output of the DC control system 32 and generates a DC drive signal A. The DC Detector A 34 receives the DC drive signal A. A DC Amplifier B receives the output of the DC control system 32 and generates a DC drive signal B. The DC Detector B 36 receives the DC drive signal B.

In operation, since the RF signal is out of phase on the two pairs of rods, the DC signal is opposite polarity on the two pairs but equal in amplitude. A superimposed DC offset signal is applied to all four rods so that the ions are attracted to enter the device.

Figure 4A:
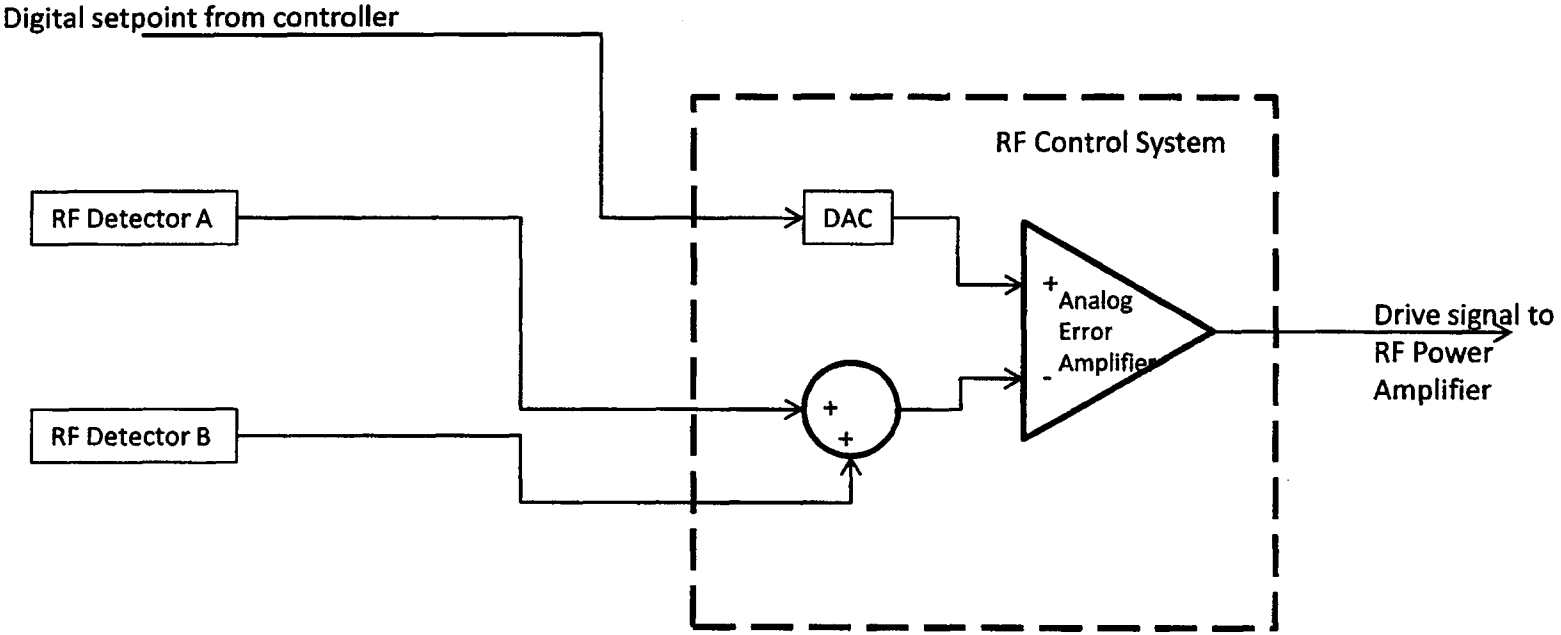
FIG. 4A (PRIOR ART)
FIG. 4A and FIG. 4B show schematic diagram for prior art control system.
Figure 4B:
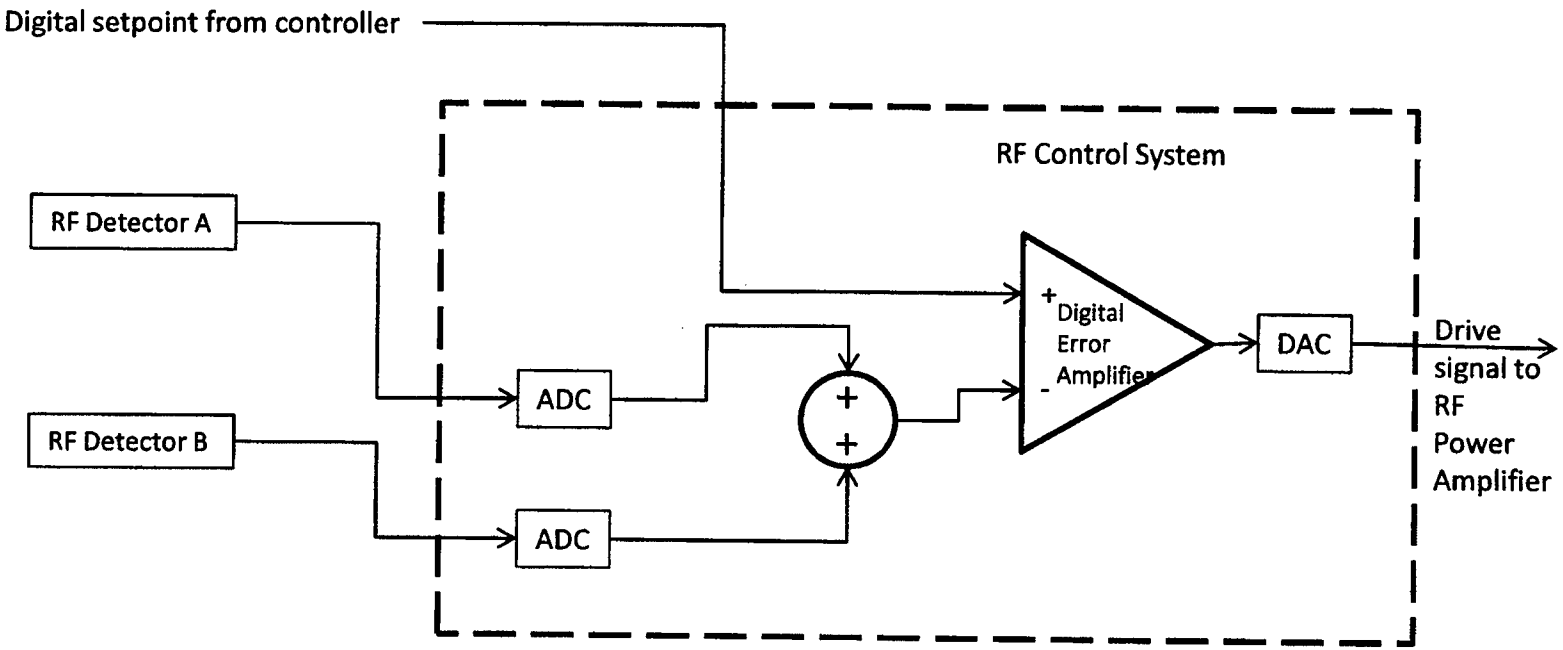
FIG. 4B (PRIOR ART)

FIG. 4A and FIG. 4B show schematic diagram for prior art control system. FIG. 4A is an embodiment of a prior art RF control system. FIG. 4B is an alternate embodiment of a prior art RF control system.

Figure 5:
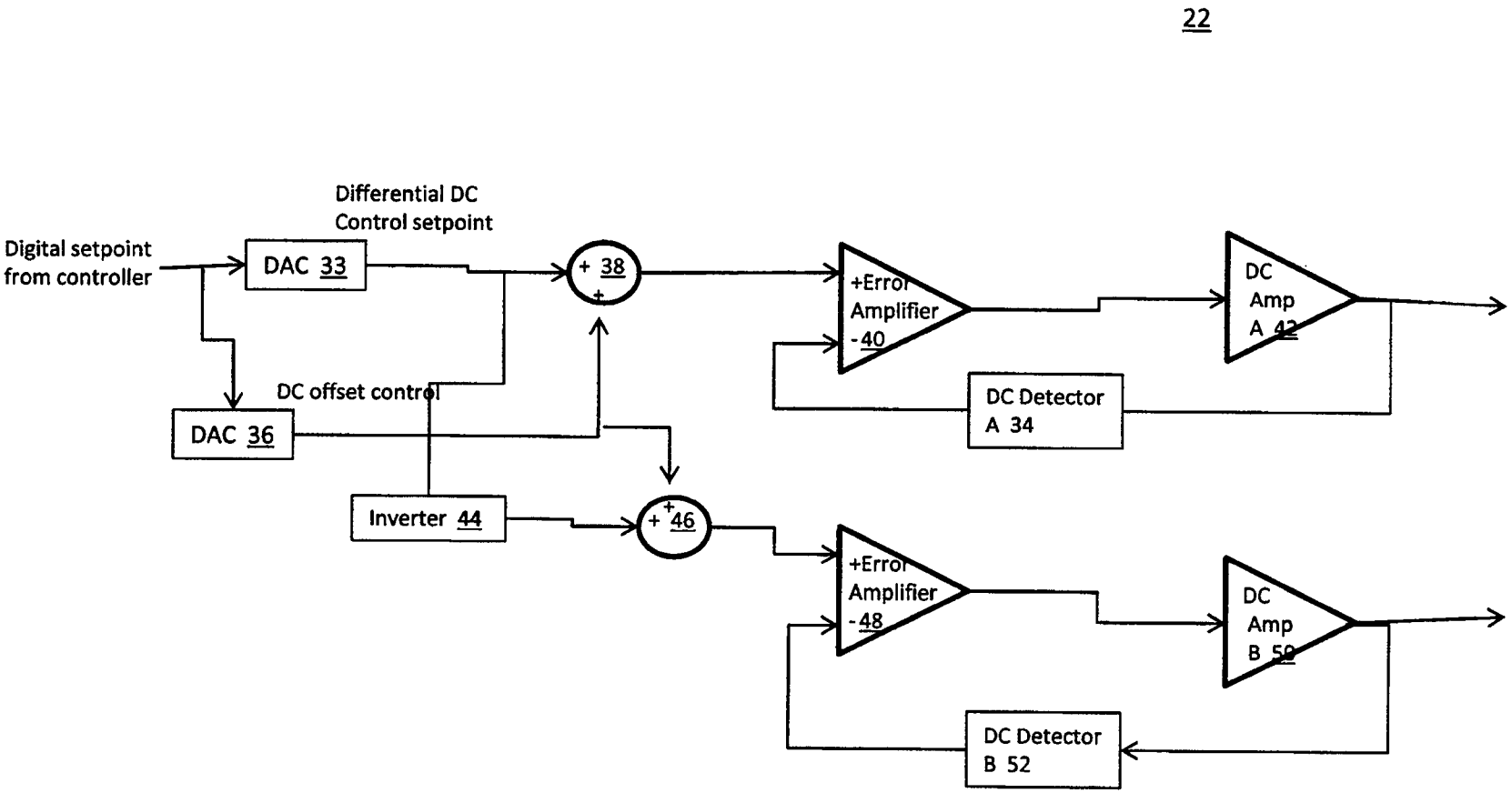
FIG. 5 shows in more detail the DC control system shown in FIG. 3.

FIG. 5 is a schematic diagram of the DC electronics 22 shown in FIG. 3. A first and a second digital to analog converter (DAC) 33, 36 receives the digital setpoint signals from the controller. The first DAC 33 generates the differential DC control setpoint signal. The second DAC 36 generates the DC offset control signal.

A first adder 38 receives the differential DC control setpoint signal and the DC offset control signal. A positive input of a first error amplifier 40 receives the output of the first adder 38. A first DC amplifier 42 receives the output of the first error amplifier 40 and generates a DC drive signal A. A first DC detector 34 receives the DC drive signal A. A negative input of the first error amplifier 40 receives the output of the first DC detector 34.

An inverter 44 receives and inverts the differential DC control setpoint signal. A second adder 46 receives the DC offset control signal and the inverted differential DC control setpoint signal. A second error amplifier 48 receives the output of the second adder 46 and generates a DC drive signal B. A second DC amplifier 50 receives the output of the second error amplifier 48 and generates a DC drive signal B. A second DC detector 52 receives the DC drive signal B. A negative input of the second error amplifier receives the output of the second DC detector 52.

In the present invention, the instrument alternates between increasing mass and decreasing mass scans, e.g. forward and reverse scans, for the purpose of decreasing inter-scan delays. Forward and reverse scanning naturally reduces spectral skewing. For beam instruments, e.g. quadrupole mass analyzers and magnetic sectors, spectral skewing results when the intensity is changing rapidly with respect to the mass scan rate. It occurs most frequently with narrow chromatographic peaks such as those found in GC/MS because of the relatively slow scanning rate.

On the leading side of the chromatographic peak, the spectrum will have abnormally high ion ratios for high m/z ions (for a scan from low to high m/z). Conversely, on the trailing side, the spectrum will have abnormally high low m/z ion ratios. An average of scans across the entire chromatographic peak will yield the approximately correct ion ratios.

Skewed spectra can adversely affect spectral deconvolution though. Algorithms are included in deconvolution packages, e.g. AMDIS, to deskew the spectra before deconvolution. Artificial spectra are created through interpolation so that each spectrum across the chromatographic peak is as if each m/z were acquired at the same time. Alternating forward and reverse scans reduces spectral skewing because each scan is skewed in the opposite direction. When averaging scans over only a portion of a chromatographic peak, for example the first half, forward and reverse scanning produces an average spectrum that is less skewed because alternating scans are skewed in the opposite direction. When averaging an odd number of scans where there is not a balanced number of forward and reverse scans, one can weight the scans so they better balance each other. For example, two reverse scans could be balanced by a double weighted forward scan which was acquired between the two reverse scans.

The setup time between scans is defined by settling time and backsteps. The settling time is the time needed for the RF and DC rod driver output signals to return to the starting point. Backsteps allow the linear control system of the RF and DC time to start tracking the setpoint. This occurs when the RF and DC driver output signals have a sudden change in their ramp rate.

Figure 6:
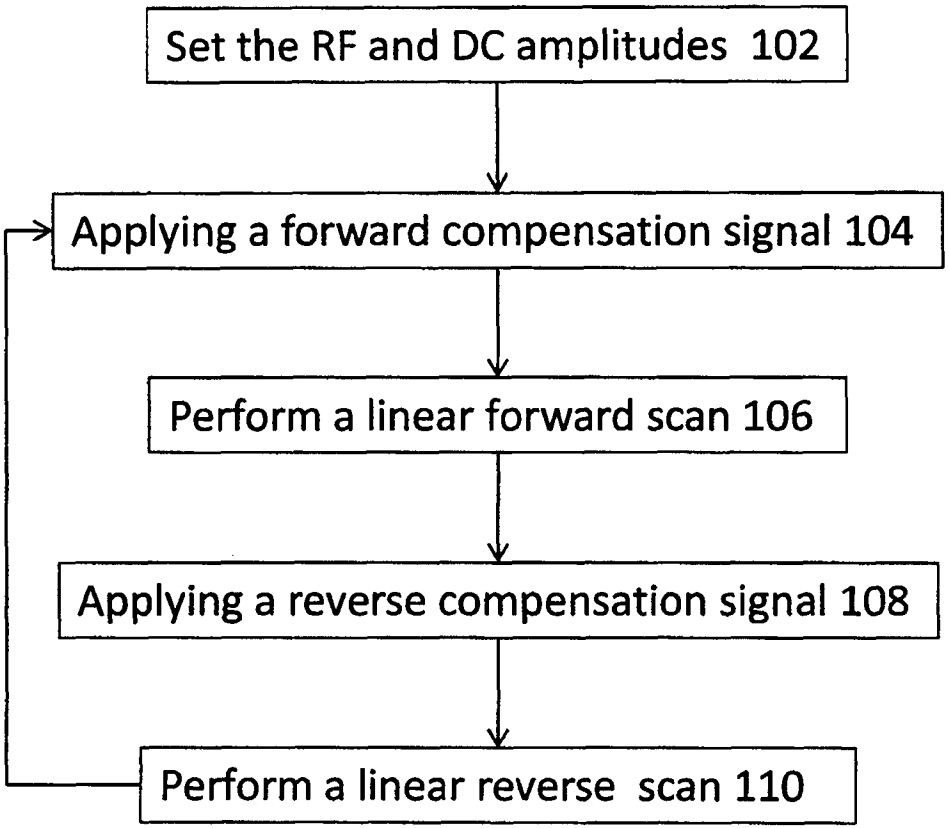
FIG. 6 is a flowchart for bi-directional scanning.

FIG. 6 is a flowchart for scanning.

In step 102, the RF and DC amplitudes are set by the digital-to-analog converters (DACs) that drive the amplifiers. One calibration technique determines what DAC value gives the voltages necessary for a specific m/z to be stable through the analyzer.

In step 104, applying a forward compensation signal where the DAC value is set at a higher value than necessary for a forward scan. Scan rate compensation is included by setting the set points higher than necessary to compensate for the constant time delay between the set point and the actual ramps.

In step 106, a linear forward scan is performed.

In step 108, applying a reverse compensation signal where the DAC value is set at a higher value than necessary for a reverse scan. The scan rate compensation may or may not be the same for the forward and reverse scans.

In step 110, a linear reverse scan is performed. This step eliminates the jump back down to low m/z associated with solely forward scans, thereby reducing the overall scanning time.

Figure 1:
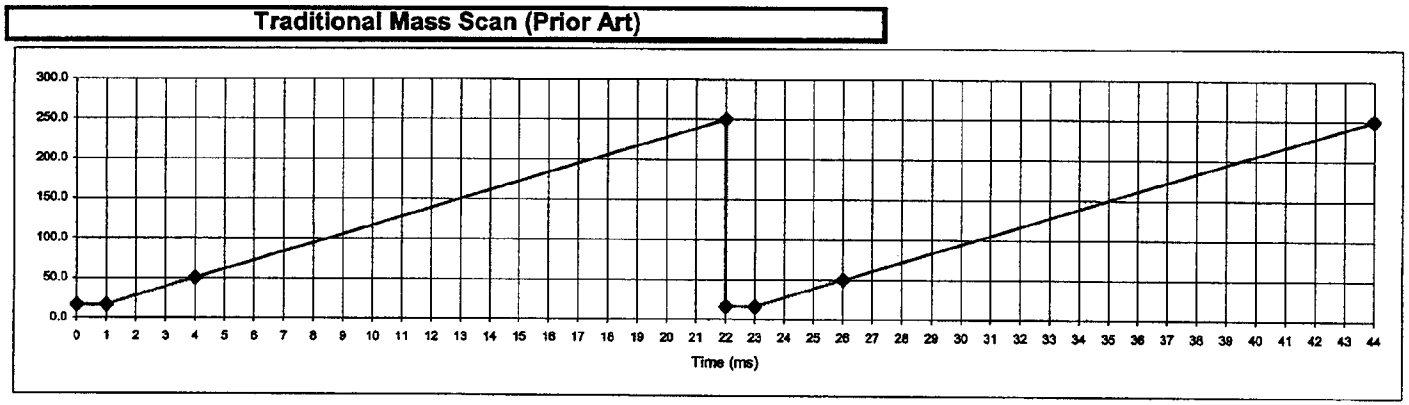
FIG. 1 (Prior Art)
FIG. 1 shows a prior art scan.
Figure 7:
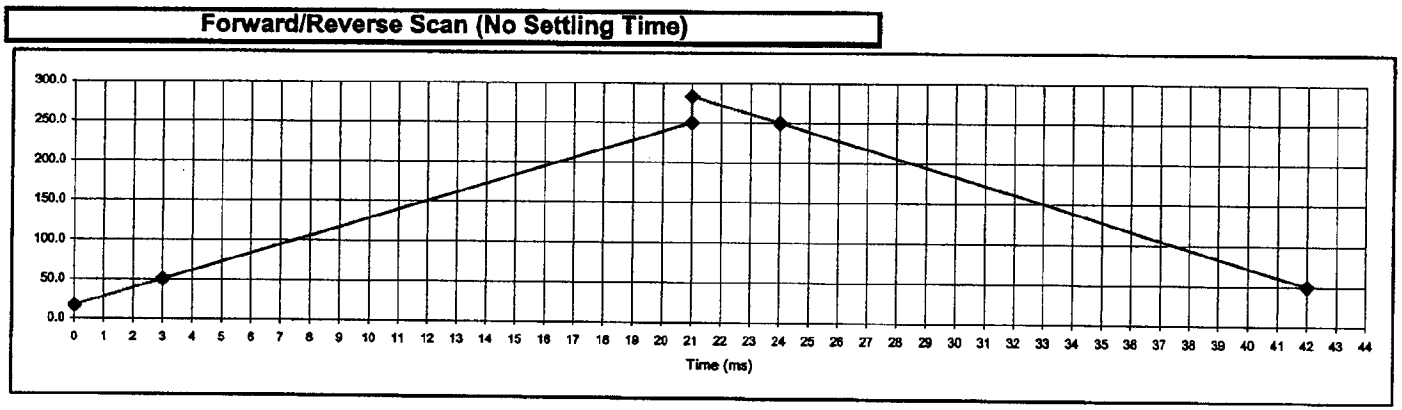
FIG. 7 shows a scan according to an embodiment of the present invention.

FIG. 7 shows a scan according to an embodiment of the present invention. The scan for a quadrupole mass spectrometer alternates between increasing mass and decreasing mass scans for the purpose of decreasing inter-scan delays. By alternating increasing and decreasing mass scans, the next scan starts where the last scan ended reducing the settling time required.

The settling time is typically between 1 and 3 ms depending on the circuitry and the size of the jump in voltage that is required. By alternating increasing and decreasing mass scans, the next scan starts where the last scan ended. This reduces the setup time between scans thus increasing the percentage of time spent measuring ions.

Figure 8:
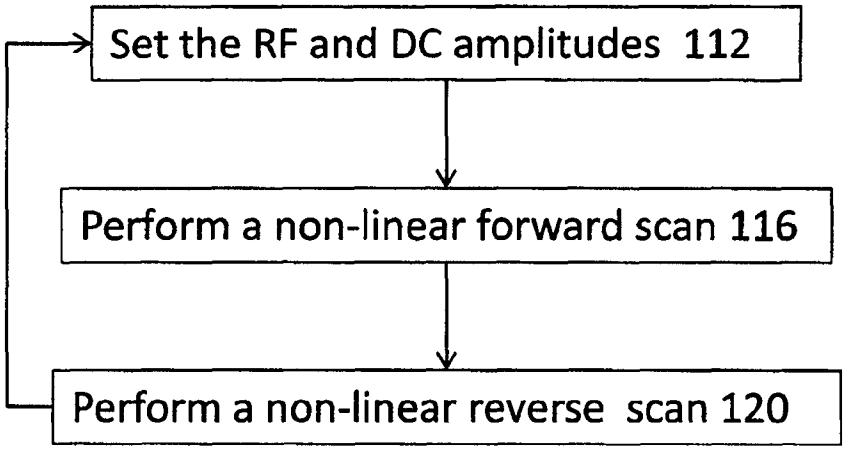
FIG. 8 is an alternate embodiment for bi-directional scanning.

FIG. 8 is an alternate embodiment for scanning. In this technique, both the settling times and backsteps have been reduced. The backsteps are eliminated by eliminating the sudden changes in the ramps of the RF and DC.

In step 112, the RF and DC amplitudes are set by the digital-to-analog converters (DACs) that drive the amplifiers. One calibration technique determines what DAC value gives the voltages necessary for a specific m/z to be stable through the analyzer.

In step 116, a non-linear forward scan is performed.

In step 120, a non-linear reverse scan is performed.

Figure 9:
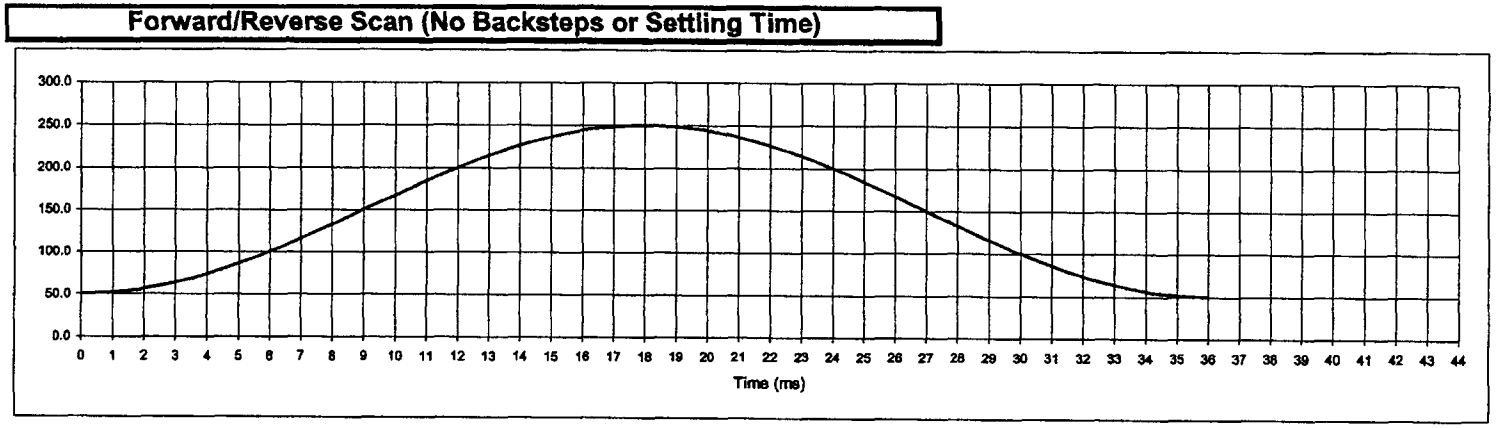
FIG. 9 shows forward and reverse scanning with a variable scan rate.

FIG. 9 shows forward and reverse scanning with a variable scan rate. Backsteps are only needed when the RF and DC driver signals have a sudden change in their ramp rate. In one embodiment, the RF and DC are scanned non-linearly. The idea is to slow down and turn around with little disruption to the control systems for the RF and DC driver signals. In other words, by avoiding abrupt changes in the RF and DC driver signals, the backsteps to get the linear control system tracking at the desired rate are not required.

For scan rate compensation, the DAC value may be a non-linear function that allows for the dwell time to be approximately the same for all m/z ions across a complete period (a forward and a reverse scan). In this illustrative example, the non-linear function is a cosine. The RF and DC must be changed more slowly at the edges of the mass range since the middle is covered twice in each pair of forward and reverse scans. Alternatively, the non-linear scan may be selected to spend more time as higher m/z where ion flux tends to be lower. The effective dwell time could be tailored across the m/z range.

Alternatively, a linear scan is performed until it is necessary to reverse direction. At this point of inflection, the scan occurs non-linearly. A conventional linear scan could be used until the end of the ramp is approached. At that point, the ramp rate could be continuously reduced until the rate is 0 at which time, the ramp starts increasing in rate in the opposite direction. Again, this eliminates settling and backsteps times.

When the scan rate does not exceed the bandwidth of the linear control system, the actual device output is a phase-shifted, e.g. delayed, version of the setpoint. In the prior art, for linear scanning, adjustments to the setpoints are made to compensate for different scan rates. The setpoint was adjusted so the actual value and desired value were equal. The RF and DC control systems typically had different delay times.

For a non-linear scan where the scan rate does not exceed the bandwidth of the linear control system, the actual device outputs are phase shifted versions of the setpoints. Similarly, the RF and DC setpoints are adjusted independently to set the actual device output to the desired values. It is critical that the RF/DC ratio be correct on the device. This is accomplished by manipulating the RF and DC setpoints so that with their respective time delays, the RF/DC ratio is the desired value. As is known in the art, the RF/DC ratio is often varied with m/z to maintain approximately constant peak width across the m/z range of the instrument.

For linear scans $$\frac{m}{z} = FirstMass + ScanRate * t \qquad \text{Equation 1}$$

where Scan Rate is in amu/s. From mass calibration, it is known that $$RF_{setpoint} = Slope_{mass} * \frac{m}{z} + Intercept_{mass} \quad \text{Equation 2}$$

A similar resolution calibration shows how to adjust the $DC_{setpoint}$ with m/z. Combining equations 1 and 2 shows how to scale linearly $RF_{setpoint}$ with time. Ion intensity data are collected as a function of time. Next, equation 1 is used to convert time back to m/z to turn the time domain ion intensity waveform into a mass spectrum.

For non-linear scans, m/z=f(t) where f(t) is any function. In this illustrative cosine scan, $$\frac{m}{z} = \frac{FirstMass + LastMass}{2} - \frac{LastMass - FirstMass}{2} * \cos\left(\frac{2\pi t}{ScanTime}\right) \quad \text{Equation 3}$$

The same mass and resolution calibrations can be used to determine how to scan the devices. Then the equation is used to translate the time domain ion intensity waveform into a mass spectrum.

Figure 10:
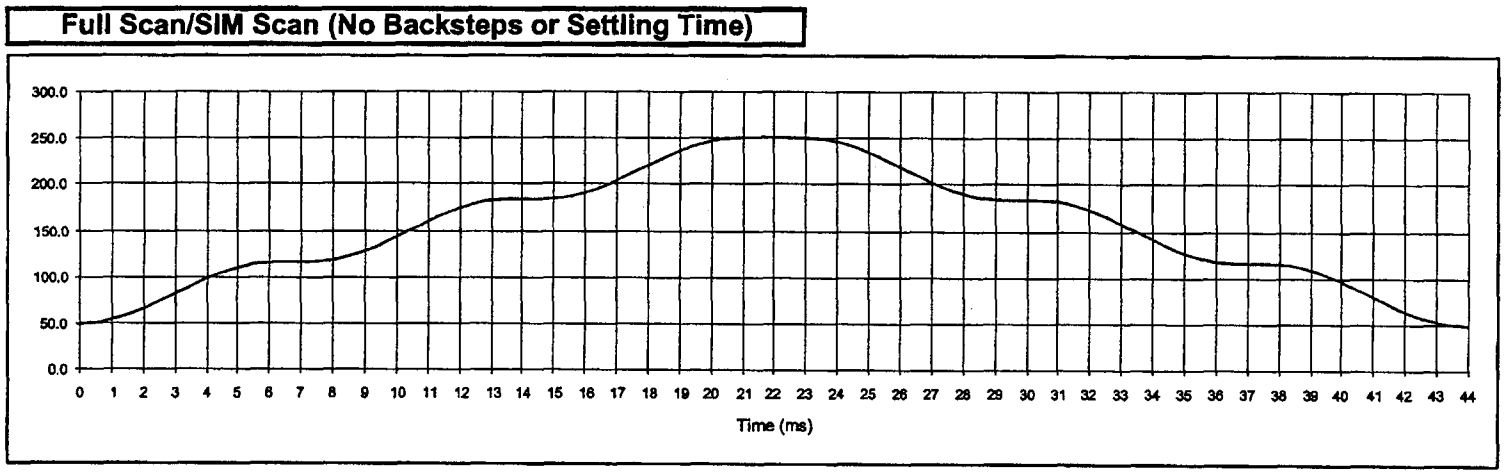
FIG. 10 shows this scan is a hybrid of a m/z 50-250 full scan and a m/z 117, 183 single ion monitoring (SIM) experiment.

With non-linear scanning, the dwell time across the m/z range may be tailored to spend more time at ions of interests. To illustrate, to scan from m/z 50 to 250, the ramp rate is slowed down around m/z 117 and 183. FIG. 10 shows this scan is a hybrid of a m/z 50-250 full scan and a m/z 117, 183 single ion monitoring (SIM) experiment.

A prior art full scan and SIM experiment involves a continuous linear ramp from m/z 50 to 250 followed by a jump to m/z 117 and subsequent dwell followed by a jump to a m/z 183 and a subsequent dwell. Part of the experiment time is spent in settling (3 times) and doing backsteps rather than acquiring data. For this illustrative example, the time is spent acquiring ion signal.

By dwelling longer at some m/z ions, lower limits of detection can be achieved for targeted analytes. By acquiring the full scan, unknown analytes can be detected that might be present in the sample. Optionally, the non-linear scans may be included in only one direction.

For non-linear scanning, more time will be spent near the first and the last m/z. Omitting an abrupt change in scan rate makes it impossible to make the dwell time constant across the mass range. However, with non-linear scanning ions are being measured during the entire scan. This more efficiently uses the scan time allowing for lower limits of detection.

The invention claimed is:

1. A method of scanning a beam mass spectrometer comprising:

generating ions from a sample; and repeatedly performing, across a chromatographic peak, the steps of:

(i) mass analyzing and detecting the ions in order of their mass-to-charge (m/z) ratios from a first m/z ratio to a second m/z ratio; and (ii) mass analyzing and detecting the ions in order of their m/z ratios from the second m/z ratio to the first m/z ratio, wherein each of the mass analyzing of the ions in order of their m/z ratios from the first m/z ratio to the second m/z ratio and the mass analyzing the ions in order of their m/z ratios from the second m/z ratio to the first m/z ratio comprises a series of non-constant dwell times, wherein the dwell times vary according to a periodic function such that each repetition of the combined steps (i) and (ii) corresponds to a single period of the periodic function and wherein extrema of the periodic function correspond to the first and second m/z ratios and such that the dwell times at both the first and second m/z ratios are greater than the dwell times midway between the first and second m/z ratios.

2. The method of scanning, as in claim 1, further comprising:

averaging results of all mass analyses across the chromatographic peak; and calculating ratios of ions generated across the chromatographic peak based on the averaging.

3. The method of scanning, as in claim 1, wherein:

the beam mass spectrometer is a quadrupole mass spectrometer; and each of the mass analyzing of the ions in order of their m/z ratios from the first m/z ratio to the second m/z ratio and the mass analyzing the ions in order of their m/z ratios from the second m/z ratio to the first m/z ratio comprises applying a control signal to the mass spectrometer.

4. The method of scanning, as in claim 3, wherein the control signal has an RF component and a DC component, and one or both of the applied RF and DC components of the control signal are non-linear functions of m/z as a function of time.

5. The method of scanning, as in claim 4, wherein the non-linear functions are cosine functions.

6. The method of scanning, as in claim 3, wherein the control signal has an RF component and a DC component, wherein portions of the applied RF and DC components of the control signal are non-linear functions of m/z as a function of time and other portions thereof are linear functions of m/z as a function of time.

7. The method of scanning, as in claim 3, wherein an RF voltage amplitude applied to the beam mass spectrometer is phase shifted from a setpoint of an RF component of the control signal by a first time delay and a DC voltage applied to the beam mass spectrometer is phase shifted from a setpoint of a DC component of the control signal by a second, different time delay, and wherein the setpoints of the RF and DC components are adjusted independently such an RF/DC ratio is at a desired value.

8. A method of scanning a beam mass spectrometer comprising:

generating ions from a sample; and repeatedly performing, across a chromatographic peak, the steps of:

(i) mass analyzing and detecting the ions in order of their mass-to-charge (m/z) ratios from a first m/z ratio to a second m/z ratio; and (ii) mass analyzing and detecting the ions in order of their m/z ratios from the second m/z ratio to the first m/z ratio, wherein each of the mass analyzing of the ions in order of their m/z ratios from the first m/z ratio to the second m/z ratio and the mass analyzing the ions in order of their m/z ratios from the second m/z ratio to the first m/z ratio comprises a series of non-constant dwell times, wherein the dwell times vary according to a periodic function such that each repetition of the combined steps (i) and (ii) corresponds to a single period of the periodic function and such that the dwell times are lengthened at m/z ratios corresponding to ions of interest.

9. A method of scanning a beam mass spectrometer comprising:

generating ions from a sample; and repeatedly performing, across a chromatographic peak, the steps of:

(i) mass analyzing and detecting the ions in order of their mass-to-charge (m/z) ratios from a first m/z ratio to a second m/z ratio; and (ii) mass analyzing and detecting the ions in order of their m/z ratios from the second m/z ratio to the first m/z ratio, wherein each of the mass analyzing of the ions in order of their m/z ratios from the first m/z ratio to the second m/z ratio and the mass analyzing the ions in order of their m/z ratios from the second m/z ratio to the first m/z ratio comprises a series of non-constant dwell times, wherein the dwell times vary according to a periodic function such that each repetition of the combined steps (i) and (ii) corresponds to a single period of the periodic function and such that the dwell times increase with increasing m/z ratio in an inverse relationship to ion flux.

* * * * *